US010971118B2

(12) United States Patent
Powers

(10) Patent No.: US 10,971,118 B2
(45) Date of Patent: Apr. 6, 2021

(54) GUITAR

(71) Applicant: TAYLOR-LISTUG, INC., El Cajon, CA (US)

(72) Inventor: Andrew Taylor Powers, Carlsbad, CA (US)

(73) Assignee: TAYLOR-LISTUG, INC., El Cajon, CA (US)

( * ) Notice: Subject to any disclaimer, the term of this patent is extended or adjusted under 35 U.S.C. 154(b) by 103 days.

(21) Appl. No.: 15/815,814

(22) Filed: Nov. 17, 2017

(65) Prior Publication Data

US 2019/0156795 A1 May 23, 2019

(51) Int. Cl.

| | |
|---|---|
| ***G10D 1/08*** | (2006.01) |
| ***G10D 3/02*** | (2006.01) |
| ***G10D 3/04*** | (2020.01) |
| ***G10D 3/12*** | (2020.01) |

(52) U.S. Cl.

CPC ..... *G10D 1/085* (2013.01); *G10D 1/08* (2013.01); *G10D 3/02* (2013.01); *G10D 3/04* (2013.01); *G10D 3/12* (2013.01)

(58) Field of Classification Search

CPC ..... G10D 1/085; G10D 3/12; G10D 3/04; G10D 3/06; G10D 3/10

See application file for complete search history.

(56) References Cited

U.S. PATENT DOCUMENTS

| | | | | |
|---|---|---|---|---|
| 4,031,801 | A * | 6/1977 | Cecchini | G09B 15/06 84/465 |
| 6,426,454 | B1 * | 7/2002 | Gregory | G10D 1/00 84/267 |
| 2003/0177883 | A1 * | 9/2003 | Rose | G10D 3/04 84/298 |
| 2004/0134329 | A1 * | 7/2004 | Turner | G10D 3/04 84/298 |
| 2013/0055876 | A1 * | 3/2013 | Mason | G10D 3/04 84/298 |
| 2018/0033409 | A1 * | 2/2018 | Colas | G10D 3/04 |

FOREIGN PATENT DOCUMENTS

| | | | | |
|---|---|---|---|---|
| EP | 1022719 | A2 | 7/2000 | |
| EP | 1156474 | A2 | 11/2001 | |
| FR | 002619946 | A1 * | 3/1989 | G10D 1/005 |
| WO | 2012126060 | A1 | 9/2012 | |

OTHER PUBLICATIONS

PCT International Search Report and Written Opinion dated Mar. 14, 2019, for International Application No. PCT/US2018/0055044.

* cited by examiner

*Primary Examiner* — Kimberly R Lockett
(74) *Attorney, Agent, or Firm* — Patterson & Sheridan, LLP

(57) ABSTRACT

A guitar comprises a body having a bottom and sides and a top. An outer perimeter of a top is attached to an upper rim of the sides, wherein an upper surface of the top is in tension due to bending of the top into a substantially domed shape and wherein the thickness of the top is thinner in the area of the outer perimeter than a central portion, thereby reducing the tension in the upper surface of the top in the area of the outer perimeter.

20 Claims, 12 Drawing Sheets

GUITAR

BACKGROUND

Field

Embodiments described herein generally relate to a guitar. More specifically, the invention relates to a guitar wherein aspects of the sound produced by the instrument are tuned by means of a varying amount of tension in the top of the guitar. In one embodiment the variation is brought about by creating tension in the guitar top and then providing a varying amount of thickness of the guitar top with a corresponding variance of rigidity. In another aspect, the invention relates to apparatus and methods for anchoring the bridge of a guitar to the body thereof. In yet another aspect the invention relates to an adjustment means for adjusting the location of a saddle portion of the guitar bridge relative to the bridge itself.

Description of the Related Art

The top of a guitar, electric or acoustic is primarily responsible for the sound quality produced by plucking a guitar string. The action of vibrating strings is governed largely by the structure the strings are anchored to and tensioned across. The more rigid the structure is made, the more the structure is resistant to vibrating. A structure resistant to vibrating will absorb little of the string's energy allowing the string to continue vibrating for an extended length of time. This characteristic of a rigid supporting structure and corresponding longer sustaining string vibration is manifested in a long sustaining musical tone of the instrument; this quality is a benefit to the musician performing on such an instrument.

The disadvantage of a rigid supporting structure is that the imparted limitation on vibration directly impacts the ability of the structure to resonate and convert the vibration of the strings into audible volume. Volume is measured in amplitude of vibration. Volume is necessary for a musical instrument to amplify the vibration of the strings. This is true even when the volume produced by a guitar is amplified electrically as in the case of an electric guitar. The more flexible the supporting structure of the instrument is, the higher the amplitude or potential volume of the produced musical tones.

There exists between the two considerations of the structure supporting the strings a direct opposition. Namely, opposition between the rigidity needed for long sustaining vibration and flexibility needed to produce audible volume in the form of vibrational amplitude. Conventionally, instruments are constructed in a manner which attempts to balance rigidity and flexibility to result in a musical instrument possessing both sustain and volume.

In the case of acoustic guitars, bracing is used on an underside of the guitar top to crease stiffness in certain areas. Electric guitars, because they have much smaller internal spaces in the interior of the body do not lend themselves to structural bracing on the underside of the guitar top. What is needed is a way to tune the sound of an electric guitar by creating tension at predetermined areas of the top. Additionally, there is a need to more effectively and simply attach components to an electric guitar top including a bridge assembly to anchor the strings at the body and to permit easy adjustment of a saddle portion of the bridge assembly in order to change the length of a string that is suspended and permitted to vibrate.

SUMMARY

The present disclosure generally comprises a guitar having a body with a body with a bottom and sides, a top attached to the body in a manner wherein an upper surface of the top is in tension due to bending of the top into a substantially dome shape and wherein the thickness of the top is thinner in the area of the outer perimeter of the top than a central portion, thereby reducing the tension in the upper surface of the top in the area of the outer perimeter.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present invention relates to components of a guitar including the guitar top as well as the guitar bridge assembly and adjustment thereof. More particularly, the invention relates to a novel way of tuning an electric guitar by changing the thickness of the guitar top in predetermined areas to affect rigidity in those areas. Additionally, other embodiments relate to a novel way to anchor a bridge assembly and the provision of a more effective way to adjust a saddle member of the bridge. While the Figures and description of a preferred embodiment relate to an electric guitar, it will be understood that aspects of the invention can be equally valuable when utilized with an acoustic guitar or any other stringed instrument utilizing a top that enhances sound quality.

Figure 1:
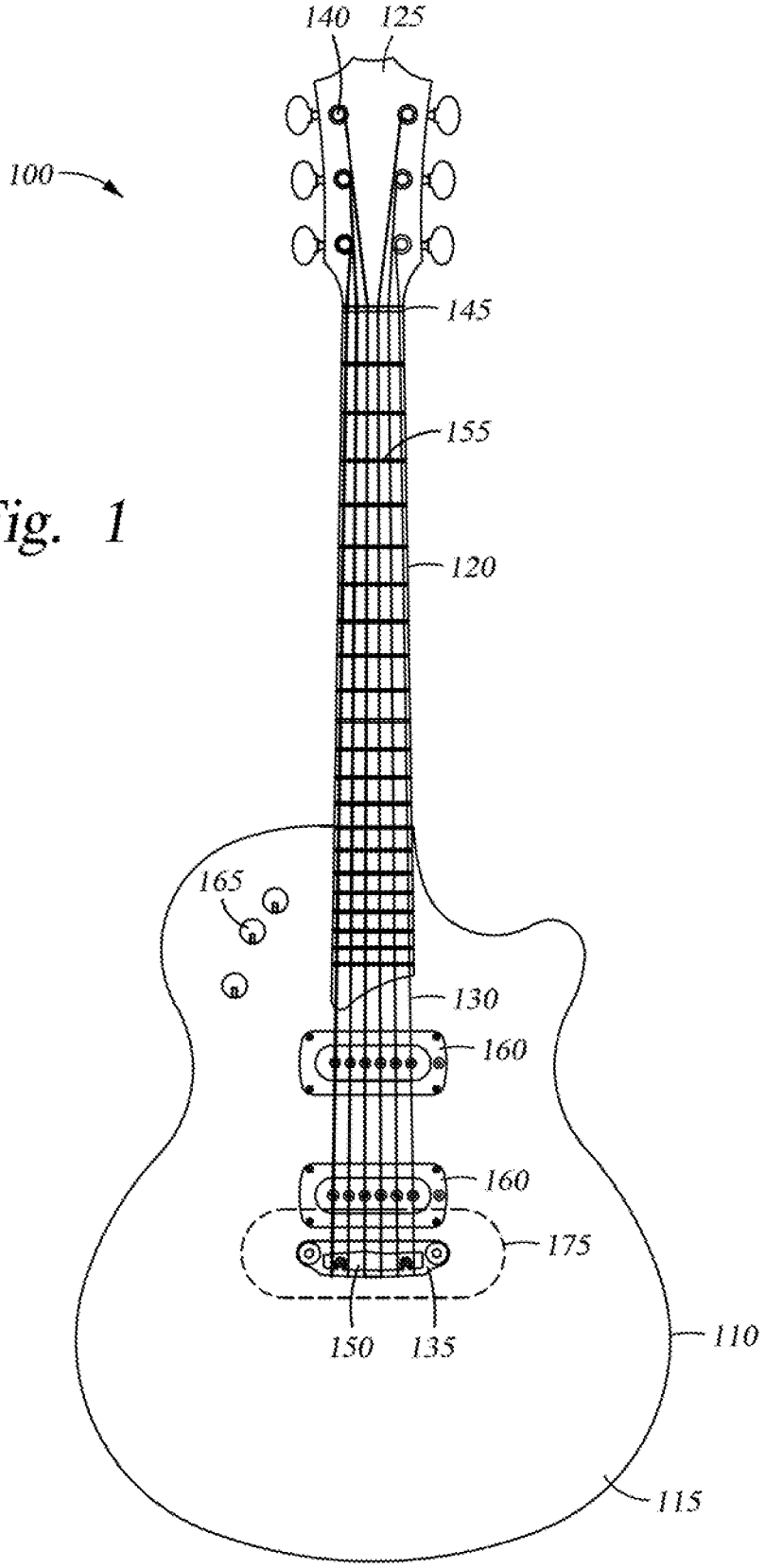
FIG. 1 is a top view of an electric guitar including some aspects of the invention.

FIG. 1 is a top view of an electric guitar 100 including some aspects of the invention. The guitar includes a body 110 having a top 115, a neck 120 attached at one end to the body and a headstock 125 formed at an opposite end of the neck. Strings (typically 6) 130 run the length of the guitar from a bridge 135 located on the guitar top 115 to tuning pegs 140 located on the headstock. The strings are suspended between a nut 145 at the headstock end and a saddle 150 located on the bridge 135 at an opposite end. The neck 120 is equipped with frets 155 along its length permitting any or all of the vibrating length of the strings 130 to be essentially shortened in order to change their pitch. Because the guitar is an electric guitar, it includes pickups 160 as well as tone and volume controls 165.

Figure 2:
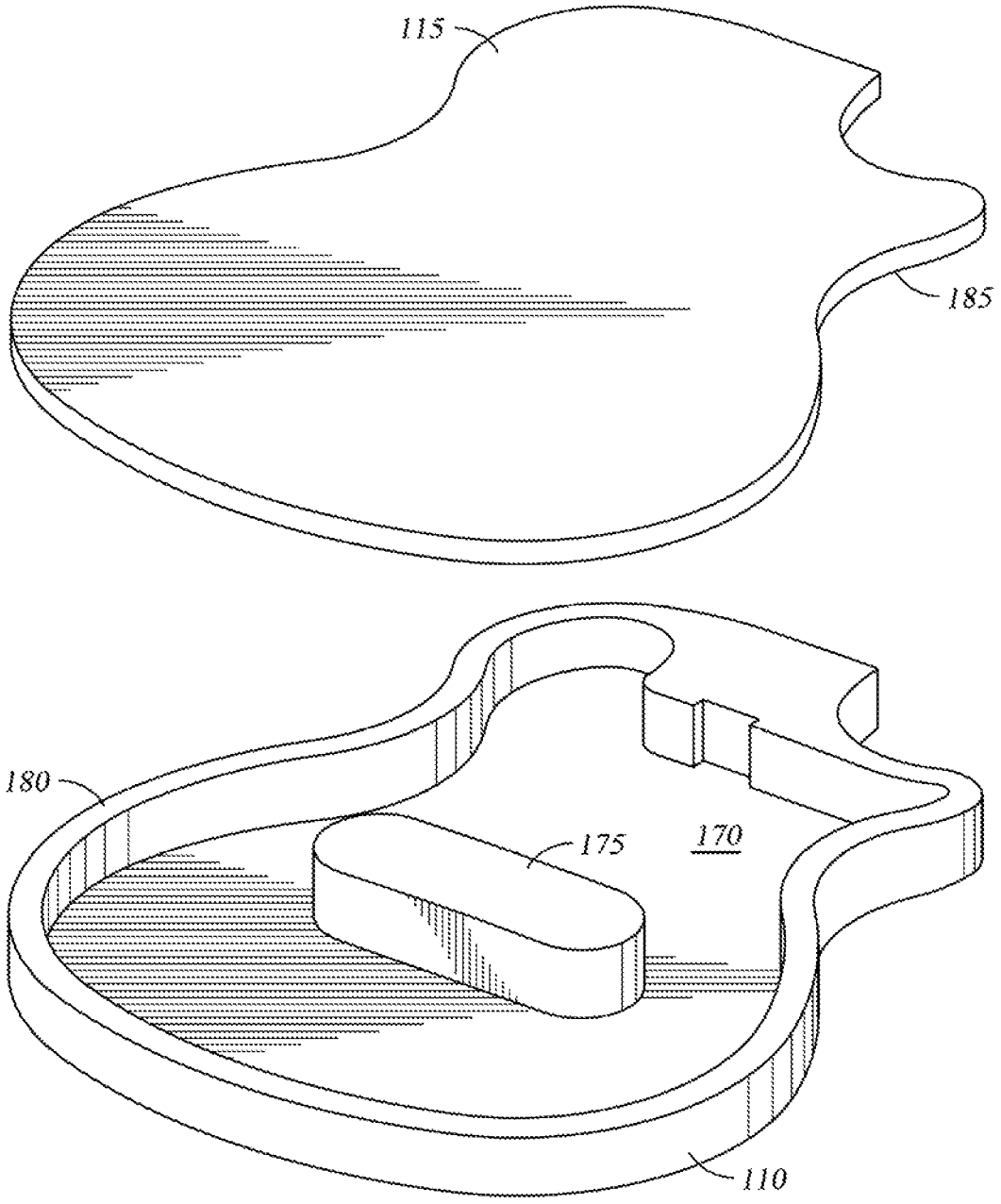
FIG. 2 is a perspective view of the guitar body and separately, the top of the guitar.
Figure 4:
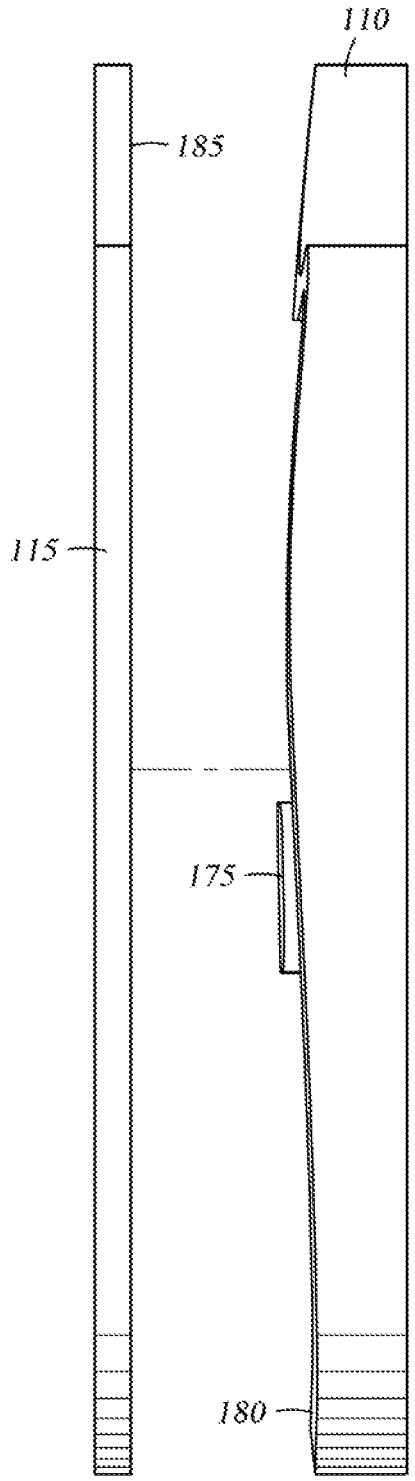
FIGS. 4 and 5 are side and end views respectively of the guitar body and top.
Figure 5:
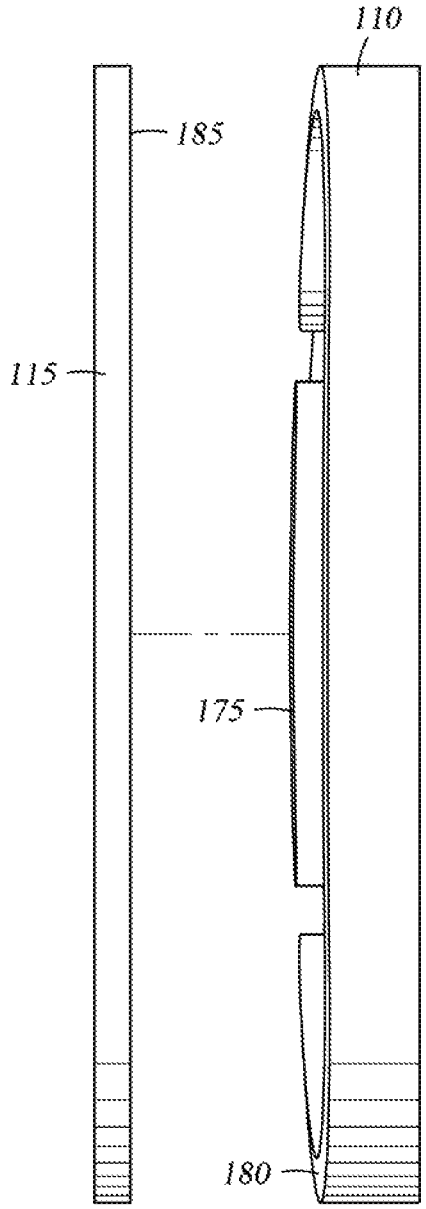

FIG. 2 is a perspective view of the guitar body 110 with the top 115 removed. In the example shown, the guitar is a partially solid guitar shown having a cavity 170 formed in the interior of the body and a bridge support 175 partially filling the cavity. The top 115, which may be of a different material like a different wood, is typically attached at its lower edge 185 to an upper rim 180 of the body 110 with a glue adhesive (not shown). FIGS. 4 and 5 are side and end views respectively of the guitar body 110 and top 115. In each Figure, the bridge support 175 is visible as well as the upper surface and lower edge 185 of the top and the upper rim 180 of the body 110 that will receive the lower edge 185.

Figure 3:
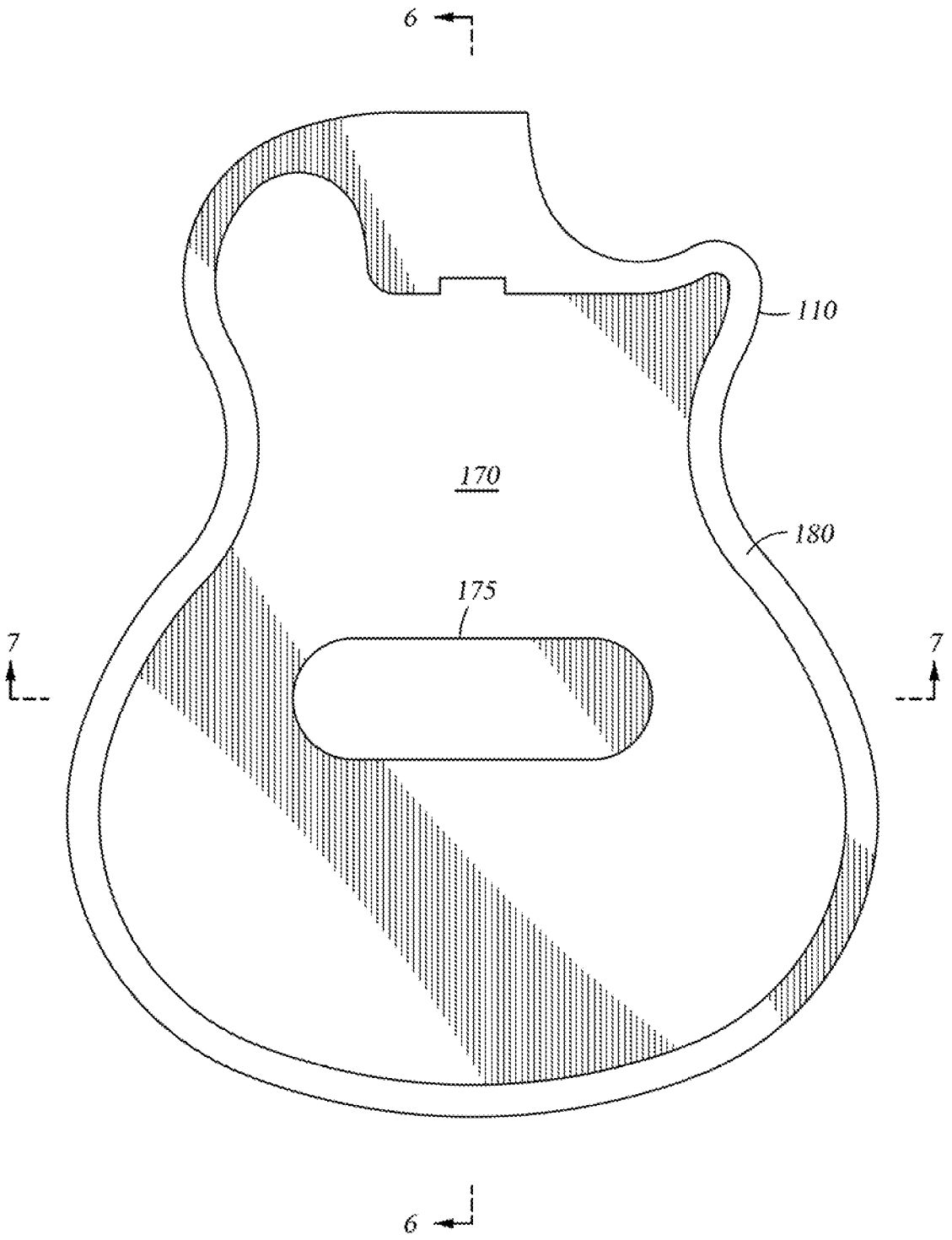
FIG. 3 is a top view of the guitar body of FIG. 2.
Figure 6:
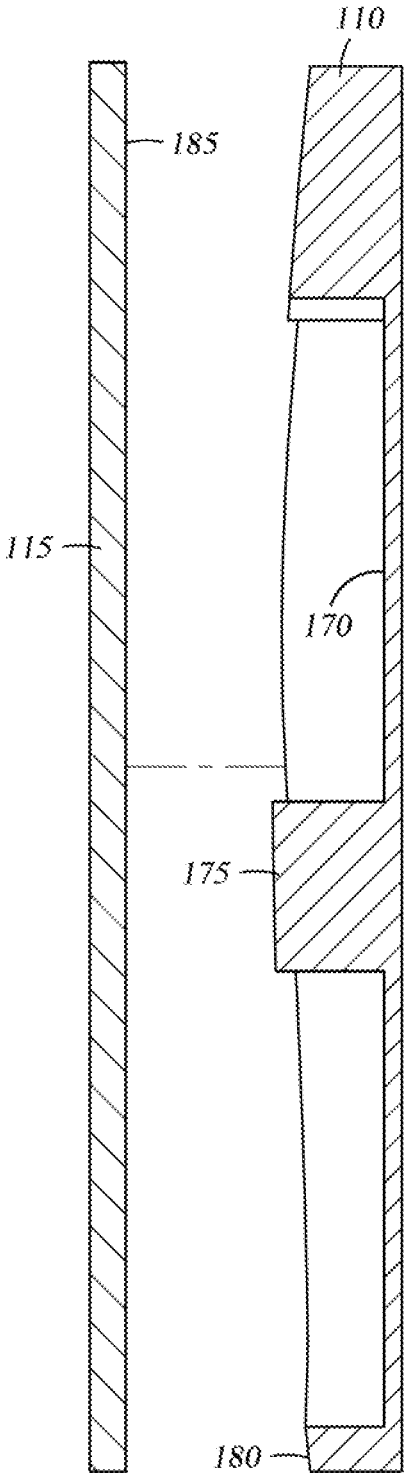
FIGS. 6 and 7 are section views of the guitar body and top of FIGS. 4 and 5.
Figure 7:
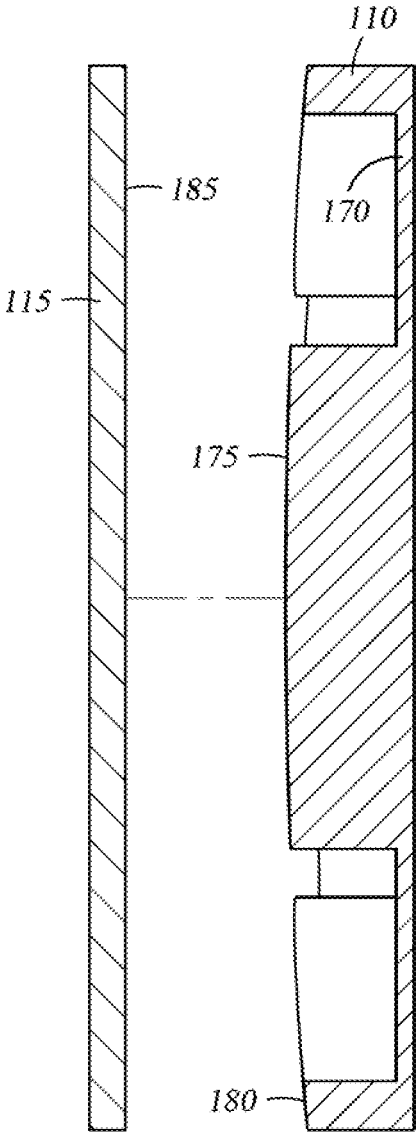

FIGS. 6 and 7 are section views of the guitar body 110 and top 115 of FIGS. 4 and 5 taken from 6-6 and 7-7 of FIG. 3 and showing the bridge support 175 as well as the various surfaces of each part. In the embodiment shown, the upper rim 180 and the upper surface of the bridge support 175 form a convex profile that will create a correspondingly concave shape on the underside of the top 115 when it is installed on the body. The existence of the convex profile of the body in each view ensures that the top will be substantially dome-shaped when installed on the body.

Figure 8:
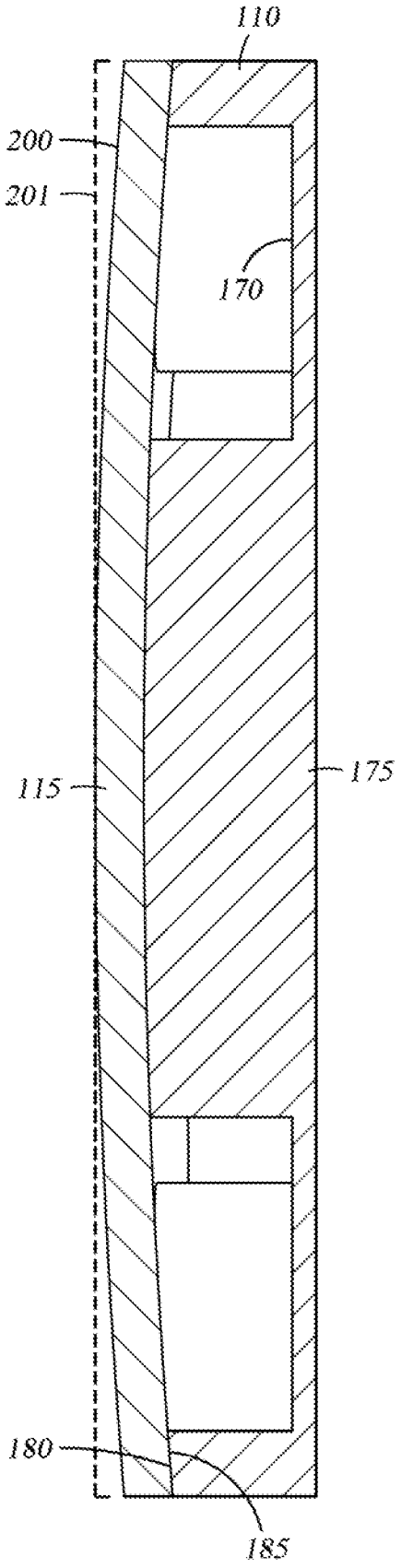
FIG. 8 is a sectioned end view showing the guitar top after it has been installed on the guitar body.

FIG. 8 is a section view taken perpendicular to the direction of the guitar strings 130 (not shown) and shows the guitar top 115 after it has been attached to the body 110 along the upper rim 180 the body and lower 185 edge of the body. As shown, the upper surface of the top 115 has been urged into a convex profile 200 corresponding to the convex profile of the upper surfaces of the body 110 and bridge support 175 and attached at each end to the corresponding edge 180 of the body, typically with an adhesive designed for woods. In one example, the top is clamped in its dome-shaped position while drying. In addition to the post attachment, convex profile 200 of the top, the original profile 201 is shown in dotted lines.

Figure 9:
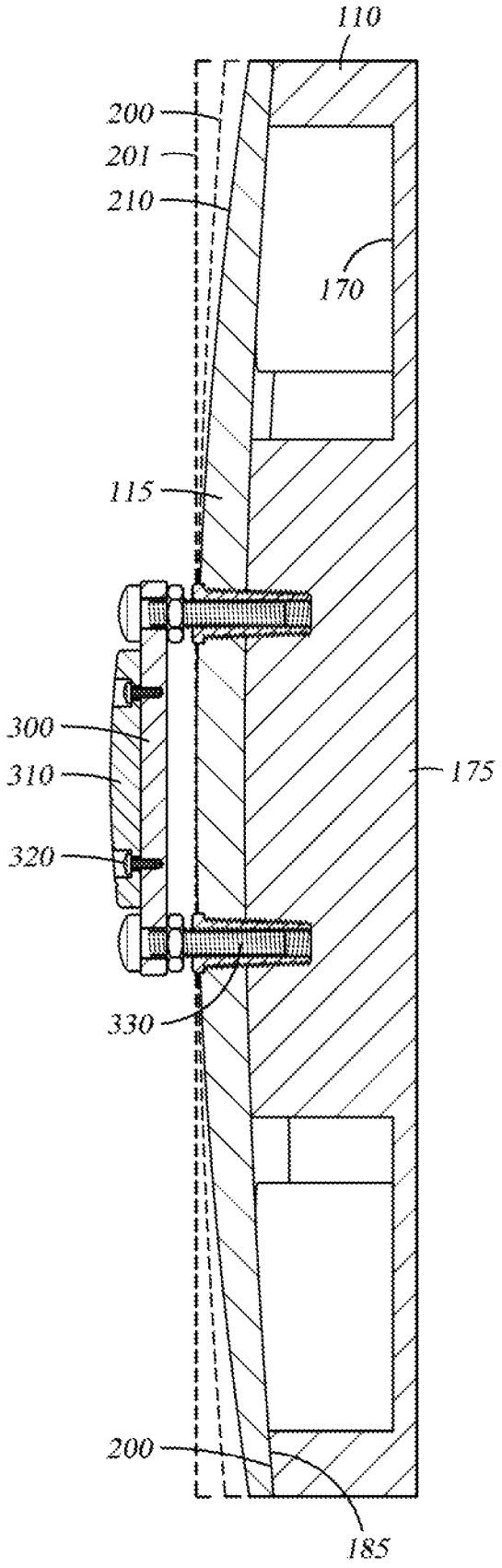
FIG. 9 is the sectioned end view of FIG. 8, showing material removed from the outer perimeter of the top and also showing a bridge assembly anchored to a bridge support formed in the guitar body.

FIG. 9 is the section view of FIG. 8 but in addition to showing the original 201 and post attachment 200 profiles of the top in dotted lines, a profile 210 is shown after material has been removed from the outer perimeter of the top 115, resulting in a reduced thickness of the top in the area of attachment to the body 110. The primary reason for removing the material is to reduce the tension in the top that was created when it was bent into the dome-shape. Also shown in FIG. 9 is the bridge 135 visible in FIG. 1 and used to anchor the strings at the body. The bridge in the embodiment shown is an assembly including a bridge portion 300, an adjustable saddle 310 attached to the bridge with adjustment screws 320, and anchor bolts 330 used to anchor the bridge to the bridge support 175 formed in the body. In practice, the bridge 300 would typically be installed and anchored to the bridge support 175 after the top 115 is installed on the guitar body 110.

Figure 10:
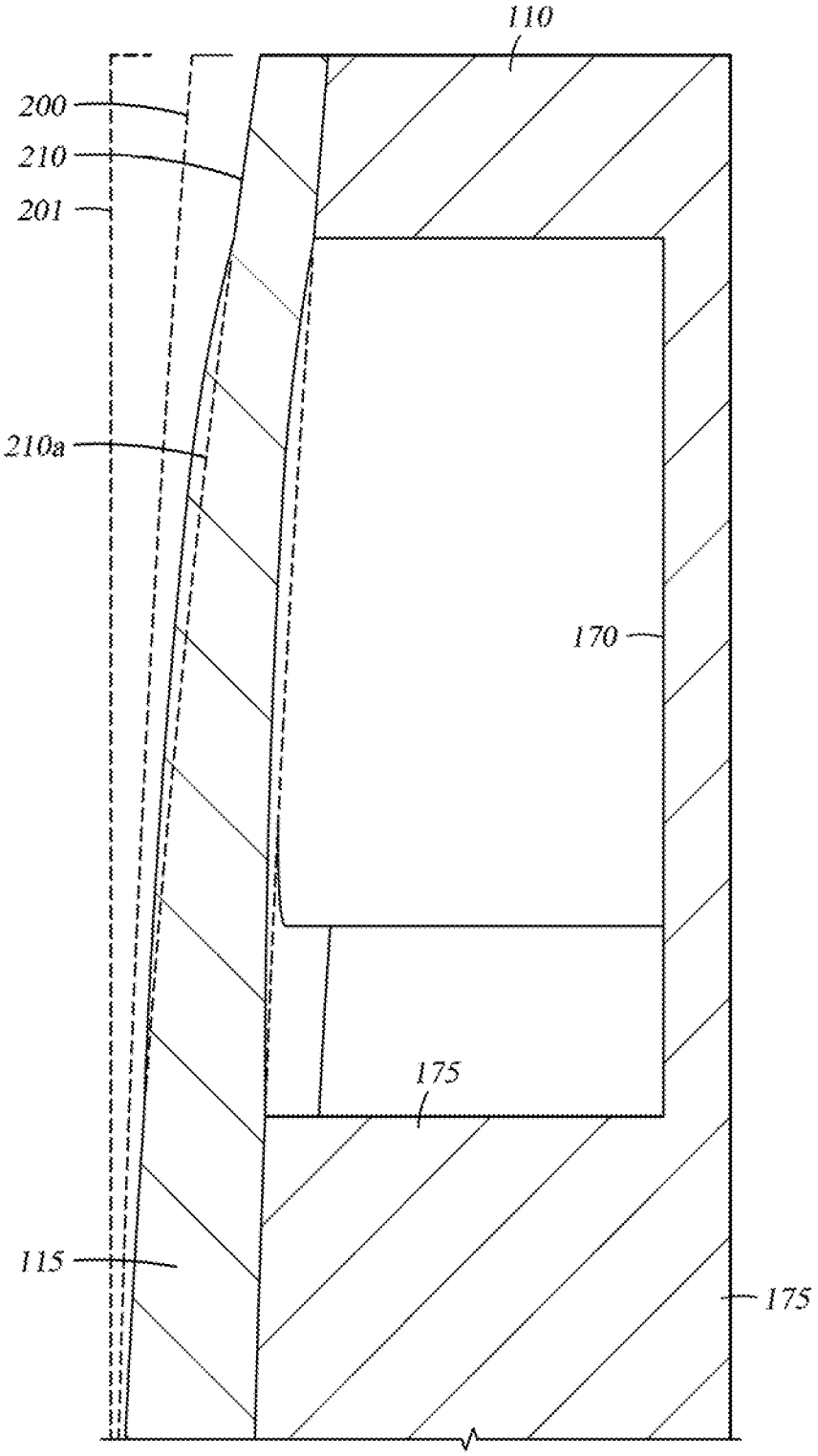
FIG. 10 is an enlarged section view illustrating deformation of the guitar top.

FIG. 10 is an enlarged, more detailed section view illustrating deformation of the guitar top 115 brought about by stresses in the top 115 as a result of being urged into a dome shape and reduced in thickness in the area of attachment to the body 110. In the example, the post material removal profile 210 includes a portion that has been deflected upwards as a result of its thickness being reduced. The original, non-deflected portion is shown in dotted line 210*a*.

Once the top is installed and the material removed, the top will be in tension or stress on its upper surface, and compression or strain on its underside. Because the top is "bent" not in a single axis but into a multi-axis dome shape, these stresses are magnified many times, resulting in some amount of tension throughout the top.

In one embodiment, the top is bent into a dome shape using the convex profile created by the upper rim 180 of the body 110 and upper surface of the bridge support 175, and then glued in place. Once the glue is dry, the perimeter of the top can be thinned out, typically in the area of attachment to the body. The material can be removed by sanding or in a preferred embodiment, with a milling machining and cutters, followed by sanding. In another embodiment, material is removed by hand sanding. In the embodiments shown and discussed, the original top 115 is essentially a planar member having a uniform thickness. It will be understood however, that the top could initially be somewhat dome-shaped and that initial shape could be further enhanced by installation onto a body having a convex profile along its upper surface as described herein. Similarly, the top 115 could be of varying thicknesses initially and then, after installation on the body, its thickness could be further reduced around the perimeter. Additionally, the preferred embodiment presumes a bridge support 175 formed in a cavity 170 of the guitar body 110 that facilitates the bending of the top during installation. The invention could be practiced without a bridge support that functions as a guide for bending the top. Also, while the top 115 is described as being done-shaped after installation, it will be understood that due to the differing length and width of the body, the dome-shaped top might not be spherical, but will typically be somewhat elongated in a direction running parallel to the strings.

Figure 11:
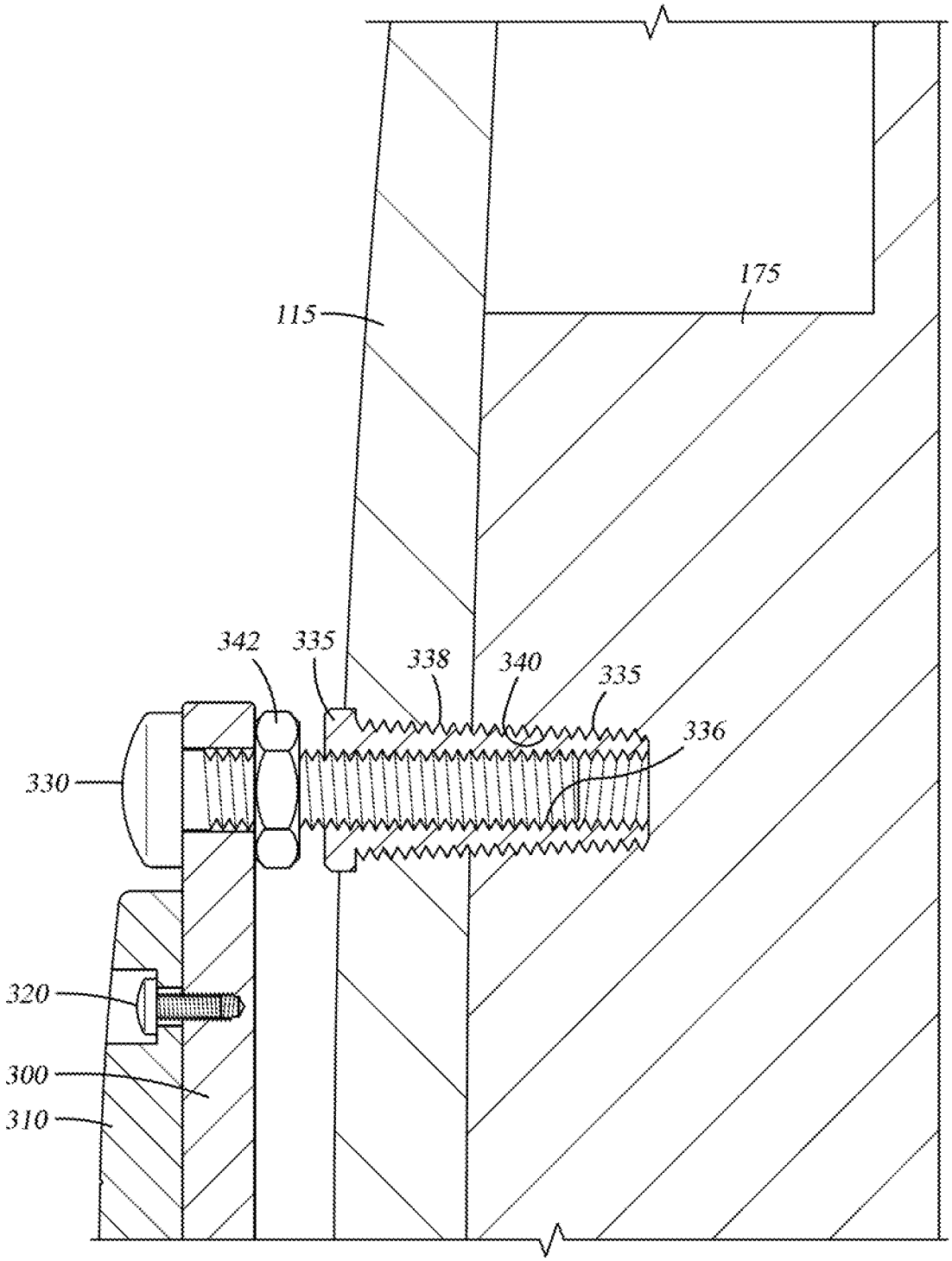
FIG. 11 is an enlarged section view of the guitar body and top showing the bridge portion of the bridge assembly anchored to the bridge support with an anchor bolt.

FIG. 11 is a section view of the guitar body and top showing the bridge 300 anchored to the bridge support 175 with one of the two anchor bolts 330. In the embodiment shown, each bolt 330 is held by a receiver 335 which is an insert having threads formed on an inner 336 and outer 338 diameters thereof. The receiver 335 is typically formed of metal-steel, stainless steel, brass, or potentially aluminum, since these materials resist deformation under the stress imparted to them from string tension on the bridge 300 which is transferred to the anchor bolts 330. In one example, the receiver 335 is threaded into pre-tapped female threads 340 in the guitar top 115 and bridge support 175. Thereafter, with the receiver in place, the anchor bolt 330 is threadedly inserted. An adjustment nut 342 between the upper portion of the receiver and a lower surface of the bridge 300 permits the relative height of the bridge and the saddle 310 thereabove to be adjusted by a user relative to the guitar top 115. In prior art arrangements, the anchor bolts and any receiver-type device are not threaded. Rather, outwardly extending longitudinal ridges or flutes running the length of the receiver serve to anchor the receiver in the bridge support after the receiver is driven in axially. The arrangement often results in the bolts tipping forward over time due to the force of the tensioned strings urging the bolts in the direction of the headstock. The novel embodiment disclosed herein, because it uses a threaded engagement between the insert and the material of the top and bridge support, results in a more robust and sturdier assembly that is less likely to fail over time.

Figure 12:
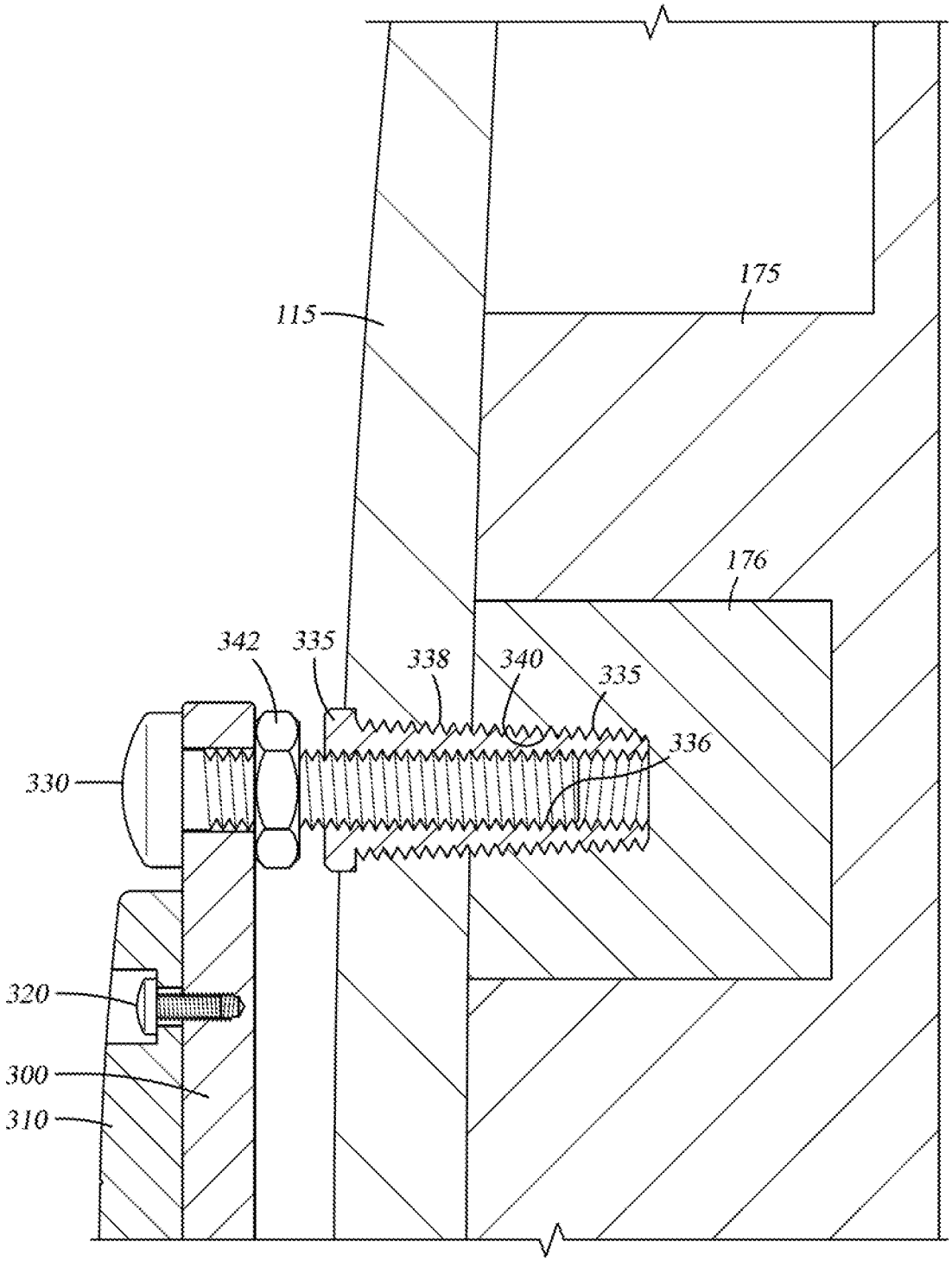
FIG. 12 is an enlarged section view of the guitar body and top and illustrating a separate piece of material utilized in the bridge support for receiving the anchor bolt.

FIG. 12 is a section view of the guitar body and top like FIG. 11. However, in FIG. 12 a separate and distinct piece of anchoring material 176 is utilized in the bridge support 175 for receiving the anchor bolt 330. Separating the anchoring material from the remainder of the bridge support permits the anchoring material to be chosen for its strength and permits the remainder of the support to be a different, more sonically desirable material. In one embodiment, a cavity is formed in the bridge support 175, and the material 176 for receiving the anchor bolts is inserted and glued in place prior to the top 115 being installed on the guitar body. For example, the material 176 for receiving the bolts could be a hard maple, rosewood, or ebony chosen because of the relative hardness of those woods, whereas the main bridge support 175 material might be a softer and lighter weight wood like mahogany, alder, ash, or spruce.

Figure 13:
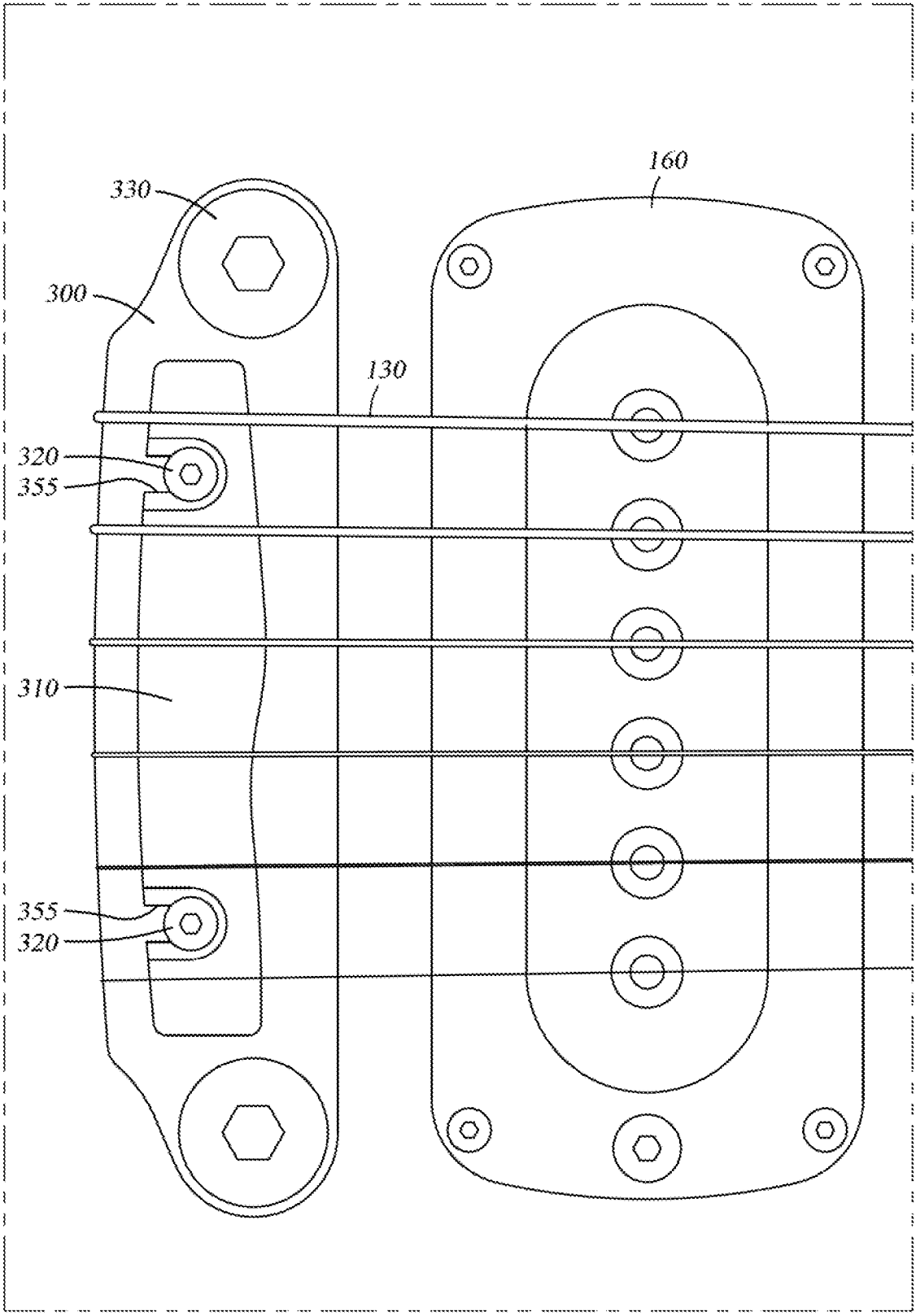
FIG. 13 is a top view of the bridge assembly of the guitar showing an adjustment means for a saddle portion.
Figure 14:
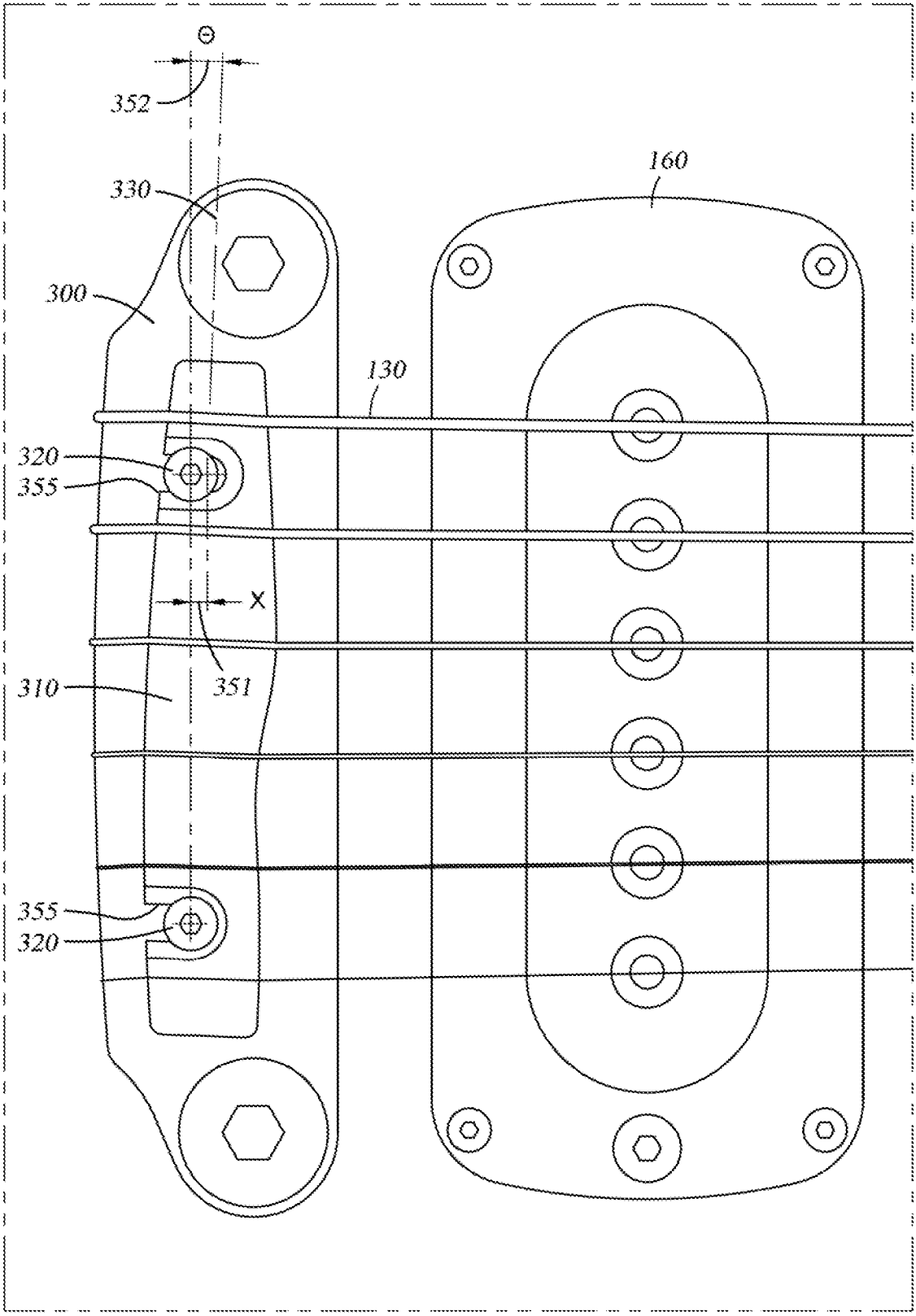
FIG. 14 is the top view of FIG. 13, with the saddle adjusted to a different position relative to the bridge.

FIGS. 13 and 14 are top views of a portion of the guitar 100 showing the bridge assembly and a pickup 160. The view illustrates some of the same components of the bridge assembly that are visible in FIGS. 10-12. In particular, the Figures show a novel arrangement for adjusting the position of the saddle 310 relative to the guitar top 115. As explained herein, the length of a guitar string that is permitted to vibrate and sound is that portion that is suspended between the nut at the headstock end of the guitar and the saddle at the bridge end. In one prior art arrangement, the saddle of a guitar is adjusted by adjusting the bridge upon which it is mounted. In another prior art arrangement, the saddle can be independently adjusted but only by removing the entire bridge assembly in order to access certain fasteners. In the embodiment shown, the saddle 310 is adjustably mounted on the bridge 300 with adjustment screws 320, each of which is mounted in a slot 355 formed at each end of the saddle 310. The screws and slots are constructed and arranged to permit the adjustment of the saddle towards and away from the headstock of the guitar, thereby increasing or decreasing the length of a string that is supported between the saddle and nut and permitted to vibrate when plucked. In every case, the saddle adjustment is accomplished without disturbing the location of the bridge.

In FIG. 13 for example, the screws 320 are both seated at a closed end of their respective slot 355, resulting in a relatively short length of string available for vibration. FIG. 14 shows one possible adjustment of the saddle 310 in relation to the bridge 300. In the example, a left side of the saddle 310 remains in its original position in its slot 355 while the adjustment screw of the right side of the saddle has been loosened and the right side of the saddle essentially rotated clockwise and then re-tightened, thereby changing the position of the right side of the saddle and creating a distance 351 and an angle 352 between the right and left sides of the saddle. The result of the arrangement in FIG. 14 is that a longer length of the larger diameter strings is available for vibrating compared to the smaller diameter strings. While the slots 355 are illustrated in the Figures as having an open end and a closed end, an open end is not necessary as a closed slot could still permit the desired movement of the saddle and screw 320 within the slot 355.

While the foregoing is directed to embodiments of the present disclosure, other and further embodiments of the disclosure may be devised without departing from the basic scope thereof, and the scope thereof is determined by the claims that follow.

The invention claimed is:

1. A guitar, the guitar comprising:

a body, the body having a bottom and sides;

a top, an outer perimeter of the top attached to an upper rim of the sides; and a neck extending from the body;

wherein an upper surface of the top is in tension due to bending of the top into a substantially domed shape and wherein a thickness of the top is thinner in an area of the outer perimeter than a central portion, thereby reducing the tension in the upper surface of the top in the area of the outer perimeter.

2. The guitar of claim 1, wherein the top is thinner in the area of the outer perimeter due to material removal from the upper surface of the top after attachment of the top to the body.

3. The guitar of claim 2, wherein the body includes a bridge support extending upwards from the bottom of the body, an upper surface of the bridge support extending above the upper rim of the sides.

4. The guitar of claim 3, further including a cavity formed in an interior of the body, the bridge support extending from the cavity.

5. The guitar of claim 1, wherein the upper rim of the sides is tapered in a manner whereby an inside edge of rim is higher than an outside edge thereof.

6. The guitar of claim 5, wherein the upper surface of the bridge support forms a dome-shaped profile complementing the tapered upper rim of the sides.

7. The guitar of claim 6, wherein the tapered upper rim of the sides and the upper surface of the bridge support form a dome-shaped profile when viewed from either side or either end of the body.

8. The guitar of claim 1, further including a bridge assembly installed on the upper surface of the top and anchored to the bridge support, the bridge assembly including a saddle.

9. A method of assembling a guitar, comprising:

providing a substantially planar top; and providing a body having a cavity therein, the body further having:

sides extending therearound, the sides having an upper rim, the upper rim tapered in a manner whereby an inner edge of the rim is higher than an outer edge thereof;

a bridge support formed in the cavity, an upper surface of the bridge support and the tapered upper rim of the sides forming a dome-shaped profile when viewed from either side or either end of the body;

installing the top on the body in a manner whereby an upper surface of the top assumes a dome shape as a result of the upper surface of the bridge support and the tapered upper rim of the sides;

removing material from the upper surface of the top in an area of attachment of the top to the sides of the body; wherein the upper surface of the top has a first tension force in its center and a second, lower tension force around its perimeter.

10. The method of claim 9, wherein material is removed using rotary cutters.

11. The method of claim 10, wherein material is removed by sanding.

12. The method of claim 8, wherein the top is retained on the body using glue between areas of contact between the body and the top.

13. The method of claim 12, wherein areas of contact include an underside of the outer perimeter of the top and the rim of the sides.

14. A guitar, the guitar comprising:

a body, the body having a bottom, sides, a top, and a cavity formed in an interior thereof and a bridge support formed within the cavity;

a neck extending from the body;

a bridge attached to the top with at least two anchor bolts, the anchor bolts extending through the top and secured within the bridge support with a threaded connection between an outer surface of the bolts and an inner surface of the bridge support; and a receiver disposed between each anchor bolt and the inner surface of the bridge support, the receiver having inner threads for a threaded connection to the anchor bolt and outer threads for a threaded connection to the bridge support.

15. The guitar of claim 14, wherein the receiver is a metallic insert.

16. The guitar of claim 14, wherein the material of the bridge support anchoring the anchor bolts is a first, harder material and a remainder of the material of the bridge support is a second softer material.

17. A guitar, the guitar comprising:

a body, the body having a bottom, sides, a top, a cavity formed in an interior thereof and a bridge support formed within the cavity;

a neck extending from the body with a headstock at a distal end; and a bridge assembly attached to the top with at least two anchor bolts, the bridge having a saddle disposed thereon and adjustable relative to the bridge in a direction towards and away from the headstock, the saddle in contact with all of a plurality of strings.

18. The guitar of claim 17, wherein the saddle includes two adjustment slots and the bridge has two threaded adjustment members disposed in the slots in a manner permitting the saddle's location to be determined by each adjustment member's location in its respective slot.

19. The guitar of claim 18, wherein the adjustment slots each have an open end and a closed end.

20. The guitar of claim 18, wherein the slots and adjustment members permit each end of the saddle to be independently adjustable relative to the bridge.

* * * * *